United States Patent [19]

Stieber

[11] 4,115,830

[45] Sep. 19, 1978

[54] MONITORING SYSTEM FOR HIGH-VOLTAGE SUPPLY

[75] Inventor: Volker Adolf Wilhelm Stieber, Lafayette, Calif.

[73] Assignee: Applied Radiation Corporation, Walnut Creek, Calif.

[21] Appl. No.: 783,781

[22] Filed: Apr. 1, 1977

[51] Int. Cl.[2] ..... H01H 47/24

[52] U.S. Cl. ..... 361/187; 307/311

[58] Field of Search ..... 361/187, 174–177; 307/311

[56] References Cited

U.S. PATENT DOCUMENTS

| | | | |
|---|---|---|---|
| 2,939,018 | 5/1960 | Faulkner | 361/187 |
| 3,537,757 | 11/1970 | Griffin | 361/187 |
| 3,579,050 | 5/1971 | Basu et al. | 361/187 |

*Primary Examiner*—Gerald Goldberg

*Attorney, Agent, or Firm*—Hill, Gross, Simpson, Van Santen, Steadman, Chiara & Simpson

[57] ABSTRACT

A monitoring system for the high-voltage supply of an ionization chamber of a particle accelerator has a measuring system which is free of hysteresis and which is electrically isolated from the high-voltage to be measured by opto-electronic couplers. The measuring system controls a switching member for supervising operation of the particle accelerator.

6 Claims, 1 Drawing Figure

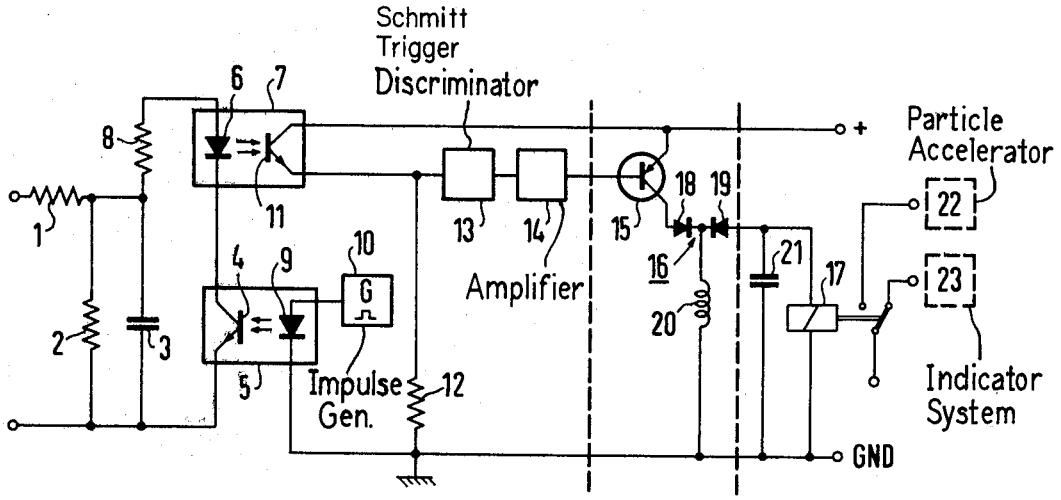
Schmitt
Trigger
Discriminator
Particle
Accelerator
Amplifier
Impulse
Gen.
Indicator
System
GND
+
1
2
3
4
5
6
7
8
9
10
11
12
13
14
15
16
17
18
19
20
21
22
23
G

MONITORING SYSTEM FOR HIGH-VOLTAGE SUPPLY

BACKGROUND OF THE INVENTION

1. Field of the Invention

The invention relates to a current-supply type monitoring system for the high-voltage supply of an ionization chamber, used preferably for the monitoring of particle accelerators.

2. Description of the Prior Art

It is known in the art of radiation systems of various types to switch them off via an ionization chamber to which the radiation is applied, as soon as a previously determined dosage of radiation has been applied. In the case of particle accelerators, it is furthermore known in the art to regulate the radiation intensity or output via the ionization current of an ionization chamber subjected to the radiation in such a way that the number of radiation impulses per unit time is changed in correspondence with the chamber signal measured. The transit time of ions produced within the ionization chambers is dependent on the spacing of the electrodes as well as on the voltage applied to the electrodes. Due to the limited life of the ions, their transit time within the chamber must be limited on the high side by decreasing the electron spacing and/or by increasing the voltage applied to the electrodes so that undesirably high losses due to recombination do not occur which would falsify the signal. The proportionality of the current flowing through the ionization chamber relating to the dosage output applied in the chamber remains constant while the supply voltage continues to increase until the electric field strength reaches a value at which the ions are accelerated to such an extent while traveling the average free path length dependent upon chamber pressure that they receive as much energy as is required for the ionization of other gas atoms. Ionization chambers are thus operated in this proportional voltage range since fluctuations of the supply voltage do not have an influence on the measured results. However, for very high dosage outputs as are present in the radiation impulses of particle accelerators or electron accelerators, considerable measurement inaccuracies have been found. This is a great disadvantage if the measured result is used for the control of accelerator intensity, i.e. for the regulation of the number of radiation impulses per time unit.

SUMMARY OF THE INVENTION

It is an object of this invention to provide a means for avoiding measuring faults in ionization chambers used for the monitoring of particle accelerators and which thus are charged with very high dose intensities for short radiation impulses. The invention is based on the recognition that in the presence of very high dosage outputs, and due to the increased probability for recombination of ions resulting from ionization density, the dependence of the measured signal on the duration of the ion in the ionization chamber and thus on the voltage applied to the ionization chamber is increased.

In the case of a current supply monitoring system of this invention, a circuit element is used which is controlled by a measuring system for high voltage which is free from hysteresis and is electrically separated from the high voltage. This has the particular advantage that the ionization chamber signal is only evaluated when the high voltage has reached a minimum value. If possible, the minimum value is in the proportional range of the ionization chamber. It is practially identical with the desired value of the high voltage. Due to the limited high voltage breakdown resulting from the nature of construction in ionization chambers and the high dose-performance impulse density in the radiation, the ionization chamber signal in practice is dependent upon the applied high voltage. In the case of a constant high voltage applied to the ionization chamber and constant dosage output for each radiation impulse, it is possible to re-calibrate the ionization current to dosage values even if the ionization chamber is operated beyond its proportional range. Due to the electrical separation of the measuring arrangement for the high voltage, faulty measurements of the dosage performance which may be produced due to electrical hum pickup circuits such as ground loops are avoided. Furthermore, due to the rapid readjustment of the dosage performance in electron accelerators it is necessary to have a measurment which is free from hysteresis as far as possible.

In a particularly advantageous further development of the invention, the measuring system includes an impulse generator which is connected to a luminous diode in a first optocoupler. This first coupler also has a phototransistor which is connected in series with a luminous diode in a second optocoupler. This luminous diode is connected to the high voltage to be measured and the phototransistor of the second optocoupler is connected to the current supply of the measuring arrangement in series with a load resistance. The load resistance is connected in parallel to the input of a discriminator whose output is connected with a switching element via a DC component blocking member. By employing the two high-voltage isolating optocouplers, the measuring arrangement is electrically separated from the high-voltage. The high-voltage is transformed into amplitude-modulated voltage impulses via the impulse generator and the two optocouplers. If the measured high voltage and corresponding amplitude of the voltage impulses exceeds a desired value pre-set in the discriminator the amplified impulses are connected to the switch member via the DC blocking member. The switch member may, for instance, be associated with a safety circuit of the particle accelerator and may switch off the latter in the event of insufficient high-voltage. This is a safeguard against individual component problems, in particular the failure of transistors which would have the exact same effect as a decrease of the high-voltage and cause the particle accelerator to be switched off. It is therefore unimportant whether the transistors become open or shorted in the case of a defect. The system will, in both cases, prevent the further conduction of periodic amplitudes. The same is true for a failure of the impulse generator or of one of the two optocouplers.

In another development of the invention, the member blocking the DC component may comprise series connected rectifier elements, one operating in the forward direction and one in the blocking direction, and an inductance connected to ground which is arranged between them. Thus, a voltage will be present at the output only when a magnetic field has been formed due to the previous half-wave. The voltage at the output of the circuit arrangement will rapidly decrease within a period of the periodic voltage pulse produced by the impulse generator as soon as the voltage impulses at the phototransistor of the second optocoupler do not reach the desired value set in the discriminator. Thus, a relay which is subject to hysteresis can be connected to the output of the circuit arrangement and may be switched during a period without making the hysteresis noticeable, provided, however, that the switching response so permits.

BRIEF DESCRIPTION OF THE DRAWING

The drawing shows a representation of the circuit arrangement for the current supply monitoring system of this invention.

DESCRIPTION OF THE PREFERRED EMBODIMENTS

On the left side of the FIGURE, a high resistance voltage divider 1, 2 is connected to the high voltage. A capacitor 3 is connected in parallel to resistor 2 of the voltage divider 1, 2. A phototransistor 4 of a first optocoupler 5 is connected in series with a luminous diode 6 of a second optocoupler 7. A protection resistor 8 connects between the diode 6 and capacitor 3. The luminous diode 9 of the first optocoupler 5 is connected to an impulse generator 10. The phototransistor 11 of the second optocoupler 7 is connected to a load resistor 12 and to the input of a discriminator 13 which preferably comprises a Schmitt trigger. The discriminator 13 connects via an amplifier 14 to the base of a semiconductor switch 15. The collector-emitter path of the semiconductor switch 15 is connected to a relay 17 to be controlled through a member 16 which blocks DC components. The member 16 which blocks the DC components consists of two series connected rectifiers 18, 19, one of which is connected in the forward direction and the other in the reverse or blocking direction, and terminals of the rectifiers 18, 19 which face each other are connected to ground via an inductance 20. A capacitance 21 for smoothing is connected parallel to the relay 17 which is to be controlled.

As soon as the high voltage is switched on, it will charge the capacitor 3 between the phototransistor 4 of the first optocoupler and the luminous diode 6 of the second optocoupler. During operation of the impulse generator 10, the diode 9 will produce short light flashes within the first optocoupler 5. This increases the conductivity of the phototransistor 4 in rhythm with the light impulses. Via this phototransistor 4 of the first optocoupler 5, the capacitor 3 discharges through the luminous diode 6 of the second optocoupler 7. Due to the light flashes of this luminous diode 6, the conductivity of the phototransistor 11 of the second optocoupler 7 connected to the supply voltage of the measuring arrangement becomes periodically conductive. Since the luminous intensity of the luminous diode is dependent on voltage, the intensity of the light flashes depends on the voltage applied to it, i.e. on the voltage applied at the capacitor 3 and received from the voltage divider 1, 2. Thus, the resistance value assumed by the phototransistor 11 of the second optocoupler 7 for each impulse depends also on the voltage on the capacitor 3, which is proportional to the high voltage. Due to the discriminator 13 whose input is parallel to the load resistance 12 of the phototransistor 11 of the second optocoupler 7, only those impulses are passed which attain a preadjusted minimum level in the discriminator. These impulses are amplified by the amplifier 14, which is arranged behind the discriminator 13 and are connected to the base of a semiconductor switch 15. The inductor 20 is supplied in rhythm with the impulses via semiconductor switch 15. Due to the first rectifier 18 which is arranged ahead of the inductance 20, the magnetic field produced in the inductance 20 between two impulses can only be reduced via the other rectifier 19 and consequently charges the capacitor 121 connected in parallel with the relay 17.

As soon as the high voltage decreases below the desired voltage set in the discriminator, the luminesence of the luminescent diode 6 also decreases to a value which renders the phototransistor 11 of the second optocoupler 7 so weakly conductive that the amplitude of the impulses arriving at the input of the discriminator 13 is too low for passage by the discriminator. Thus, the semiconductor switch 15 remains closed. The inductancee 20 is no longer supplied. The voltage across the capacitance 21 which is parallel to the relay 17 decreases within one period to a value below the holding point of the relay if the capacitance 21 is properly chosen with respect to the resistance value of the relay. Due to a corresponding selection of the frequency of the impulse generator 10, releasing times of nearly any desired shortness can be obtained. The hysteresis of the relay 17 is therefore no longer important. The switch time which can be attained is only dependent on the inertia of the applied switch 17.

If one of the component parts of the impulse generator 10, the optocouplers 5 and 7, the discriminator 13, the amplifier 14, or the semiconductor switch 15 fails, a periodic signal will no longer be transmitted. It is not important if transistors which fail are either shorted or open. Since only the periodic component is used for feeding the relay 17, a signal will not be produced given the above mentioned component failures and the relay remains in the same position as it would assume if the high voltage was insufficient. In this position of the relay, which is shown in the FIGURE, the particle accelerator 22 is not switched on or off, respectively, and instead, an indicator system 23 is switched on via the other change-over contact of the relay.

The electrical separation of the high voltage can also be effected via separation transformers, Hall generators, and field plates. In the place of members 18, 19, 20 blocking the DC, it is also possible to use a fairly large capacitor connected between the semiconductor switch 15 and the relay 17.

Although various minor modifications may be suggested by those versed in the art, it should be understood that it is intended to embody within the scope of the patent warranted hereon, all such embodiments as reasonably and properly come within the scope of this contribution to the art.

Claimed as the invention:

1. A current supply monitoring system for the kilovolt range high-voltage supply of an ionization chamber for the supervision of particle accelerators, comprising in combination:

(a) a substantially hysteresis free measuring system means for measuring the level of the high voltage supply;

(b) separator means for connection to the kilovolt range high voltage supply and electrically separating and isolating the high voltage supply kilovolt range voltages from the measuring system means; and (c) switch means for connection to the measuring system means and also to the particle accelerator for supervising operation of the particle accelerator.

2. A current supply monitoring system for the high-voltage supply of an ionization chamber for the supervision of particle accelerators, comprising:

(a) an ionization chamber high voltage supply;

(b) a substantially hysteresis free measuring system means for measuring the level of the high voltage supply;

(c) separator means electrically separating the high voltage supply from the measuring system means;

(d) switch means connected to the measuring system means for supervising operation of the particle accelerator; and (e) said measuring system means including an impulse generator which is connected with a luminous diode of a first optocoupler of the separator means, a phototransistor in the first optocoupler being connected in series to a luminous diode of a second optocoupler of the separator means, said second optocoupler luminous diode being connected to the high voltage supply which is to be measured, said second optocoupler having a phototransistor which is connected in series with a load resistance to a current supply for the measuring system, and the load resistance being connected parallel to an input of a discriminator whose output is connected to said switch means via a means for blocking DC.

3. A current supply monitoring system in accordance with claim 2 characterized in that the means for blocking the DC comprises two rectifier elements connected in series and oppositely polarized, and an inductance being connected between a reference and the junction of the two rectifier elements.

4. A current supply monitoring system in accordance with claim 2, characterized in that said switch means includes a relay controlled by the measuring system for the supervision of the particle accelerator.

5. A current supply monitoring system in accordance with claim 2, characterized in that the discriminator comprises a Schmitt trigger and an AC amplifier connected to the output of the discriminator.

6. A monitoring system for a particle accelerator, comprising in combination:

(a) a particle accelerator and an ionization chamber high voltage supply in a kilovolt range;

(b) a substantially hysteresis free measuring system means for measuring the level of the high voltage supply;

(c) separation means electrically separating and isolating the high voltage supply kilovolt range voltages from the measuring system means;

(d) discriminator means for detecting when the high voltage supply falls below a predetermined level;

(e) switch means connected to the discriminator means for supervising operation of the particle accelerator; and (f) said measuring system means including means connected to the switch means for compensating a hysteresis thereof, said measuring system means also being connected to the particle accelerator.

* * * * *